US005672047A

United States Patent [19]

Birkholz

[11] Patent Number: 5,672,047

[45] Date of Patent: Sep. 30, 1997

[54] ADJUSTABLE STATOR VANES FOR TURBOMACHINERY

[75] Inventor: Dietrich Birkholz, Olean, N.Y.

[73] Assignee: Dresser-Rand Company, Corning, N.Y.

[21] Appl. No.: 421,672

[22] Filed: Apr. 12, 1995

[51] Int. Cl.[6] ..... F01D 9/02

[52] U.S. Cl. ..... 415/160; 415/161; 415/162

[58] Field of Search ..... 416/160, 161, 416/162

[56] References Cited

U.S. PATENT DOCUMENTS

| | | | |
|---|---|---|---|
| 3,695,777 | 10/1972 | Westphal et al. | 415/160 |
| 3,887,297 | 6/1975 | Welcher | 415/161 |
| 4,130,375 | 12/1978 | Korta | 416/162 |
| 4,253,797 | 3/1981 | Weiler | 415/162 |
| 4,856,962 | 8/1989 | McDow | 415/161 |
| 5,224,820 | 7/1993 | Brichet et al. | 415/162 |
| 5,328,327 | 7/1994 | Naudet | 415/160 |

FOREIGN PATENT DOCUMENTS

| | | | |
|---|---|---|---|
| 0721565 | 11/1965 | Canada | 415/160 |
| 1169823 | 1/1959 | France | 415/162 |
| 1003512 | 2/1957 | Germany | 415/160 |

*Primary Examiner*—Edward K. Look
*Assistant Examiner*—Mark Sgantzos
*Attorney, Agent, or Firm*—Sidley & Austin

[57] ABSTRACT

An adjustable stator vane assembly disposed in a fluid conduit of a turbomachine includes an annular outer shroud and an annular inner shroud positioned within and concentric to the outer shroud to form an annular fluid flow path. A plurality of rotatable stator vanes are positioned between the outer shroud and the inner shroud and spaced apart about the circumference of the inner shroud. Each rotatable stator vane has a vane shaft attached to one end thereof and a pivot pin supporting the other end thereof. A plurality of vane stem bushings are mounted in one of the inner shroud and the outer shroud, with each bushing receiving a respective vane shaft. The distal end of each vane shaft is connected through an individual linkage to a synchronizing ring. An actuator provide arcuate movement of the ring so as to simultaneously rotate each of the rotatable stator vanes.

19 Claims, 5 Drawing Sheets

ADJUSTABLE STATOR VANES FOR TURBOMACHINERY

TECHNICAL FIELD OF THE INVENTION

The present invention relates in general to adjustable stator vanes. In one aspect, the invention relates to adjustable stator vanes which provide and maintain minimum clearance at the flowpath walls to reduce wear to the rotor blades. In another aspect, the invention relates to turbomachinery having adjustable stator vanes.

BACKGROUND OF THE INVENTION

Although this invention is applicable to adjustable stator vanes for various turbomachines, it has been found particularly useful in the environment of FCCU (Fluidized bed Catalytic Cracking Unit) expanders or expander turbines. Therefore, without limiting the applicability of the invention to "FCCU expanders", the invention will be described in such an environment.

The fluid catalytic cracking process is widely used in petroleum refining for the conversion of oil feedstocks into lighter hydrocarbons such as gasoline. The key element in the process is the particulate catalyst, which breaks down the heavy oil molecules by stripping away some of the carbon atoms, otherwise known in the process industry as "cracking", to yield smaller, lighter hydrocarbon molecules. The oil feedstock is heated by mixing it with hot catalyst particles as the feedstock enters the reactor vessel. The mixture of oil feed and catalyst is pumped up a riser column inside the reactor vessel where the cracking process actually takes place. At the top of the riser, spent catalyst particles and light hydrocarbon vapors are separated.

The regeneration of spent catalyst to fresh catalyst takes place in the fluidized bed. A byproduct of the regeneration process is a substantial quantity of hot exhaust gas that contains a considerable amount of energy in the form of pressure and temperature. The FCCU process with power recovery utilizes an axial flow expansion turbine to recover nearly all of the pressure energy in the exhaust gas and approximately twenty five percent of the thermal energy in the exhaust gas. The advantage of an FCCU process with power recovery is that, in most instances, it is possible to recover sufficient power with the expansion turbine to drive the axial compressor, which provides the combustion air necessary for catalyst regeneration. In some cases, it is possible for the expansion turbine to recover more power than the compressor can absorb. In this case, a motor/generator is usually included in the rotating equipment train so that the excess power may be used to generate electricity for the refinery.

However, this exhaust gas also contains a quantity of very fine, abrasive catalyst particles entrained in the gas stream. The carry-over catalyst particles are accelerated to a high velocity by the expansion of the fluid or gas as it passes through the axial flow expansion turbine. When the catalyst particles impact the rotor blades of the expansion turbine, severe erosion may result.

It is desirable to employ adjustable stator vanes in the axial flowpath through the expansion turbine at a location upstream of the rotor blades. In order for the stator vanes to be adjustable, the stator vanes must have some clearance at the flowpath walls, e.g., on the order of 0.06 inch. The tangential velocity component of flow through the clearance is much less than that of the main gas flow. Thus, the velocity through the clearance relative to the rotor is much larger than the main gas flow. As a result, the gas leaking through this clearance causes particles in the leaking gas to impact the rotor blades with kinetic energy which is about four times larger than the kinetic energy of similar particles in the main gas stream. It is therefore desirable to minimize the stator vane clearance at the flowpath walls.

SUMMARY OF THE INVENTION

The present invention provides a novel rotatable stator vane arrangement for an axial flow turbomachine which minimizes or eliminates the stator vane clearance at the flowpath walls.

According to the present invention, an adjustable stator vane assembly is disposed in the fluid conduit of the turbomachine upstream of the rotor blades. The adjustable stator vane assembly comprises an annular inner shroud and an annular outer shroud positioned outside of and concentric with the inner shroud to form an annular flow path therebetween for the fluid, e.g., the FCCU exhaust gas. Each of a plurality of adjustable stator vanes is mounted between the inner and outer shrouds for rotational movement about the longitudinal axis of the respective vane. The adjustable stator vanes are spaced at intervals about the circumference of the inner shroud and extend at least substantially radially outwardly (with respect to the central axis of the inner shroud) from the inner shroud to the outer shroud.

Each rotatable stator vane has one end thereof connected to a respective stator vane shaft which extends through a bushing mounted in one of the inner shroud and the outer shroud. In either situation, the vane stem bushings position the rotatable stator vanes and both shrouds so that the rotatable stator vanes extend at least generally radially with respect to the longitudinal axis of the turbine rotor shaft. The bushings can be slidably mounted so that the thermal expansions of the inner and outer shrouds (which are greater than that of the turbine housing) are accommodated without loss of concentricity of the shrouds and without significant changes in clearance between the tips of the rotatable stator vanes and the adjacent shroud.

An actuation linkage is attached between the distal end of each vane shaft and a synchronizing ring. The ring can be driven in an arcuate motion by an actuator so that the rotatable vane shafts can be simultaneously rotated by the movement of the synchronizing ring.

The outer shroud can be formed of material having a coefficient of thermal expansion which is smaller than that of the material of the inner shroud so that upon heating by exposure to hot fluid passing through the annular flow path, the radial distance between the inner shroud and the outer shroud increases at the same rate as the rotatable vane length increases. The inner shroud can be formed of a material having a coefficient of thermal expansion larger than that of the material of the outer shroud so that a clearance between the tips of the rotatable stator vanes and the adjacent shroud does not change appreciably in the range from room temperature to an operating temperature.

The tip end of each rotatable stator vane can have a spherical surface which mates with a spherical surface on the adjacent shroud so that the clearance between the tip end of the rotatable stator vane and the adjacent shroud does not change appreciably when the rotatable stator vanes are rotated.

In another aspect of the present invention, an array of fixed stator vanes can be provided upstream of the rotatable stator vanes.

BRIEF DESCRIPTION OF THE DRAWINGS

Other advantages and features of the invention will become more apparent with reference to the following detailed description of a presently preferred embodiment thereof in connection with the accompanying drawings wherein like reference numerals have been applied to like elements, in which.

DETAILED DESCRIPTION

Figure 1:
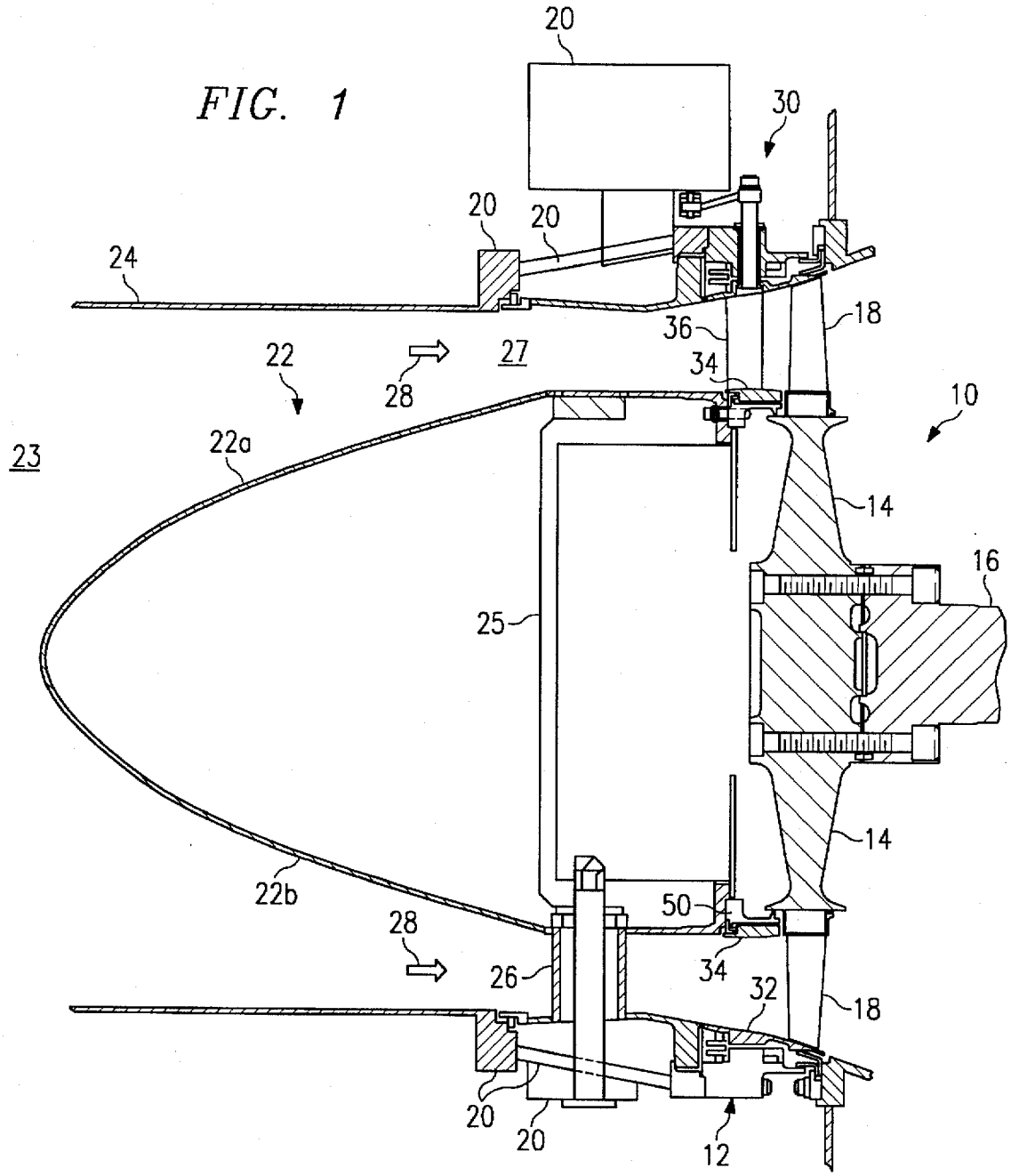
FIG. 1 is a longitudinal cross-sectional view of a portion of an expansion turbine including a first embodiment of the stator vane assembly constructed in accordance with the present invention.
Figure 2:
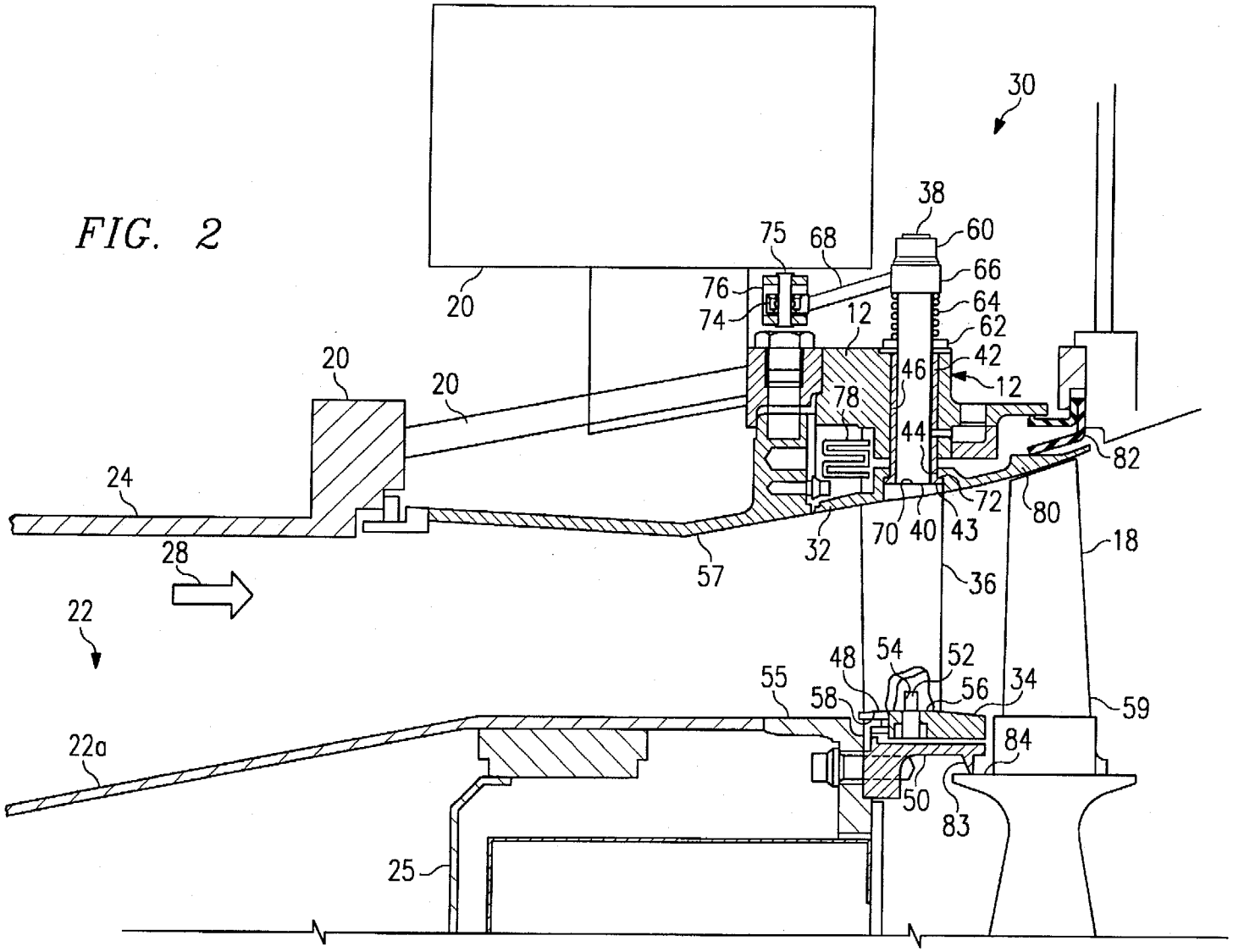
FIG. 2 is an expanded cross-sectional view of the upper portion of FIG. 1.

Referring to the drawings and FIGS. 1 and 2 in particular, shown therein and generally designated by the reference character 10 is an expansion turbine incorporating an adjustable stator vane assembly 30 constructed in accordance with a first embodiment of the present invention. For purposes of clarity and to simplify FIG. 1, various parts of the expansion turbine, as well as the adjustable stator vane assembly, are shown as a sectional view with the upper and lower portions thereof being in different planes through the longitudinal axis of the rotor shaft 16, it being realized that such elements are preferably symmetrically oriented entirely around the longitudinal axis of the rotor shaft 16.

The expansion turbine 10 basically comprises the housing 12, the rotor 14, the rotor shaft 16, a plurality of rotor blades 18, and various structural support components 20 of housing 12. The housing 12 also contains the bearings (not shown) for the rotor shaft 16, such that the rotor shaft 16 is journalled for rotation about its longitudinal axis within housing 12. The expansion turbine 10 also includes a nose cone 22, represented in FIG. 1 by an upper surface **22*a* and a lower surface 22*b*, with the nose cone 22 being coaxially positioned within the cylindrical gas inlet passageway 23 formed by inlet pipe 24. A heat shield 25 is positioned between the nose cone 22 and the rotor 14, and is joined to the downstream end of the nose cone 22**.

A plurality of hollow struts 26 extend radially outwardly from equally spaced points about the circumferential periphery of the jointure of the heat shield 25 and the nose cone 22 to the support structure 20 in order to support the heat shield 25 and the nose cone 22 coaxially with respect to the rotor shaft 16 and the housing 12. The apex of the nose cone 22 is directed upstream, so that the flow 28 of exhaust gas from the FCCU process is converted from a cylindrical path 23, defined only by the inner surface of inlet pipe 24 forming gas passageway 23, into an annular flow path 27 defined by the outer surface of nose cone 22 and the inner surface of gas passageway 23. Thus, while the hollow struts 26 are positioned in the annular portion of the gas flow 28, their diameter and their spacing about the circumference of the heat shield 25 are such as to reduce their effect on the gas flow 28.

The adjustable stator vane assembly 30 comprises an annular outer shroud 32, an annular inner shroud 34, and a plurality of rotatable stator vanes 36. The inner shroud 34 is positioned within and concentric to the outer shroud 32 to form an annular flow path therebetween for the FCCU exhaust gas. Also, both shrouds 32 and 34 are positioned coaxially with respect to the rotor shaft 16. The rotatable stator vanes 36 are spaced apart at equal intervals about the circumference of the inner shroud 34 and extend at least generally radially outwardly from the inner shroud 34 to the outer shroud 32. The bushings 42, which receive the shafts 38 of the rotatable stator vanes 36, are slidably mounted in housing 12 and extend radially to the longitudinal axis of rotor shaft 16. Each bushing 42 has an outwardly extending annular flange 43 at the inner end of the respective bushing 42, which engages an inwardly facing annular shoulder 72 of the outer shroud 32. The housing 12 fully encompasses the outer shroud 32 such that the outer shroud 32 is fully supported by the bushings 42. In turn, the inner shroud 34 is coaxially supported with respect to the outer shroud 32 by the rotatable vanes 36 engaging pins 52 mounted in the inner shroud 32.

It is presently preferred that each of the outer shroud 32 and the inner shroud 34 have a circular configuration in a plane perpendicular to the longitudinal axis of rotor shaft 16, although one or both of the shrouds 32 and 34 can have a generally frustoconical configuration so that the annular space defined by the two shrouds 32 and 34 can be decreasing or increasing with distance along a line parallel to the longitudinal axis of the rotor shaft 16.

Each rotatable stator vane 36 is mounted between the outer shroud 32 and the inner shroud 34 for rotational movement about the longitudinal axis of the respective stator vane shaft 38. Each of the rotatable stator vanes 36 has a first end 40 and a second or tip end 48. Each rotatable stator vane 36 has a stator vane shaft 38 attached to the first end 40 of the rotatable stator vane 36, with the rotatable stator vane 36 and the associated stator vane shaft 38 being at least substantially coaxial. Each stator vane shaft 38 rotatably extends through a respective one of a plurality of vane shaft bushings 42, whereby the stator vane shaft 38 can rotate about its longitudinal axis with respect to the associated bushing 42. Each vane shaft bushing 42 is supported in a respective aperture 44 in the outer shroud 32 and in a respective aperture 46 in the housing 12.

A pivot pin 52, having one end mounted in the outer portion of the inner shroud 34, extends radially outwardly therefrom and into an aperture 54 in the tip end 48 of a respective rotatable stator vane 36 to support the tip end 48 of the rotatable stator vane 36. The pivot pin 52 is positioned coaxially with respect to the longitudinal axis of the associated stator vane shaft 38 so as to permit rotation of the adjustable stator vane 36 about the longitudinal axis of the associated stator vane shaft 38.

The portion of the surface 56 of the inner shroud 34 adjacent to the tip end 48 of a rotatable stator vane 36 has a convex spherical contour and the surface 58 of the tip end 48 has a mating concave spherical contour so that the clearance between the surface 56 and the surface 58 does not change significantly when the rotatable stator vanes 36 are rotated about their longitudinal axes. If desired, the convex spherical contour can be provided on the tip end 48 and the mating concave spherical contour can be provided on the external surface 56 of the inner shroud 34. The radius of these spherical surfaces varies with the size of the turbomachine.

The inner shroud 34 is circumferentially non-segmented, i.e., it is formed as a single annular piece which is continuous about its circumferential periphery. However, it can represent only a short distance along a line parallel to the longitudinal axis of the rotor shaft 16, e.g. approximately the width of the adjustable stator vanes 36 or only somewhat longer as illustrated in FIG. 2. Thus, the inner wall of the annular flow path 27 leading to the rotor blades 18 is formed primarily by the nose cone 22 and the annular member 55. The annular member 55 can having a circular configuration in a plane perpendicular to the longitudinal axis of rotor shaft 16, and can have either a cylindrical external surface or a frustoconical external surface. The inner shroud 34 is made from a material having a coefficient of thermal expansion greater than that of the material of the outer shroud 32, so that the clearance between the tip end 48 of the rotatable stator vanes 36 and the inner shroud 34 does not change during the range of about 70° F. to an operating temperature of about 1300° F.

The outer shroud 32 is also circumferentially non-segmented, i.e., it is formed as a single annular piece which is continuous about its circumferential periphery. However, it can represent only a short distance along a line parallel to the longitudinal axis of the rotor shaft 16, e.g. approximately two to three times the width of the adjustable stator vanes 36 as illustrated in FIG. 2. Thus, the outer wall of the annular flow path 27 leading to the rotor blades 18 is formed primarily by the inlet pipe 24, and the annular wall member 57. As illustrated in FIG. 2, the annular wall member 57 can have a generally cylindrical upstream section and a generally frustoconical diverging downstream section. The outer shroud 32 is made from a material having a coefficient of thermal expansion which is smaller than that of the material of the inner shroud 34 so that upon the heating of the shrouds 32 and 34 by the hot FCCU exhaust gas, the radial distance between the inner shroud 34 and the outer shroud 32 increases at the same rate as the length of the rotatable stator vanes 36 increases from the heating thereof by the hot FCCU exhaust gas.

The tip shroud 80 for the turbine rotor 14 can be integral with the outer shroud 32 for the plurality of adjustable stator vanes 36. The outer shroud 32 is held concentric with respect to the inner shroud 34 by the vane shaft bushings 42 which are structured so as to be able to slide in housing 12 to accommodate the expansion of the outer shroud 32 relative to the housing 12. The outer shroud 32 defines the outer flow path for the exhaust gas 28 flowing past the rotatable stator vanes 36 toward the rotor blades 18, while the inner shroud 34 defines the inner flow path for the exhaust gas 28 flowing past the rotatable stator vanes 36 toward the rotor blades 18.

A primary objective of the present invention is to minimize the clearance between the inner shroud 34 and the rotatable stator vane blades 36 so as to minimize the erosion of the rotor blades 18. The foregoing features allow the use of very tight clearances between inner shroud surface 56 and stator vane surface 58 of about 0.010 inch. Each of these clearances acts to throttle the exhaust gas 28 passing through the clearance. Thus, the catalyst particles cannot attain as high a velocity relative to the rotor blades as they could attain with the more normal clearance of about 0.060 inch, and erosion at the root or base 59 of the rotor blade 18 is greatly reduced in comparison to that in the prior art.

The outer end portion of each vane shaft 38 is provided with a radially biasing and actuation structure. Each biasing and actuation structure comprises an annular seal and spacer 62, a compression spring 64, an actuation arm 68, and a fastener 60. The annular seal and spacer 62 is positioned around the outer end portion of a respective vane shaft 38 which extends beyond the associated vane shaft bushing 42 and is in contact with the housing 12. A first end 66 of the actuation arm 68 is in the form of an annulus and is positioned so that the outer end portion of vane shaft 38 also extends through the opening in the annular end 66. The compression spring 64 is concentrically positioned about the outer end portion of vane shaft 38 between the first end 66 and the spacer 62. The distal end portion of the vane shaft 38 is externally threaded to accept the internally threaded fastener 60. The fastener 60 is attached to the threaded portion of the vane shaft 38 so as to place the spring 64 in compression between first end 66 and spacer 62 and to cause the annular shoulder 70 at the first end 40 of a rotatable stator vane 36 to contact the annular flange 43 at the inner end of the bushing 42 and press the annular flange 43 against the annular shoulder 72 surrounding the aperture 44 in the outer shroud 32. Thus, the vane shoulder 70 is maintained against the bushing flange 43, which in turn is maintained against the shroud shoulder 72 during rotation of the adjustable stator vane 36 about the longitudinal axis of the stator vane shaft 38 by the actuation arm 68, thereby maintaining the clearance between the vane tip surface 58 and the curved surface 56 of the inner shroud 34.

As shown in FIG. 2, the second end 74 of each actuation arm 68 is positioned within a respective one of a plurality of circumferentially spaced apertures 26 in an annular synchronizing ring 76 and is pivotally attached by a pivot pin 75 to the annular synchronizing ring 76. The synchronizing ring 76 is positioned for rotary motion about the longitudinal axis of the rotor shaft 16 in a plane perpendicular to the longitudinal axis of the rotor shaft 16, so that the arcuate movement of the synchronizing ring 76 about the longitudinal axis of the rotor shaft 16 causes the synchronized rotational movement of all the rotatable stator vanes 36 to simultaneously change the angle of inclination thereof with respect to a line parallel to the longitudinal axis of the rotor shaft 16.

Figure 3:
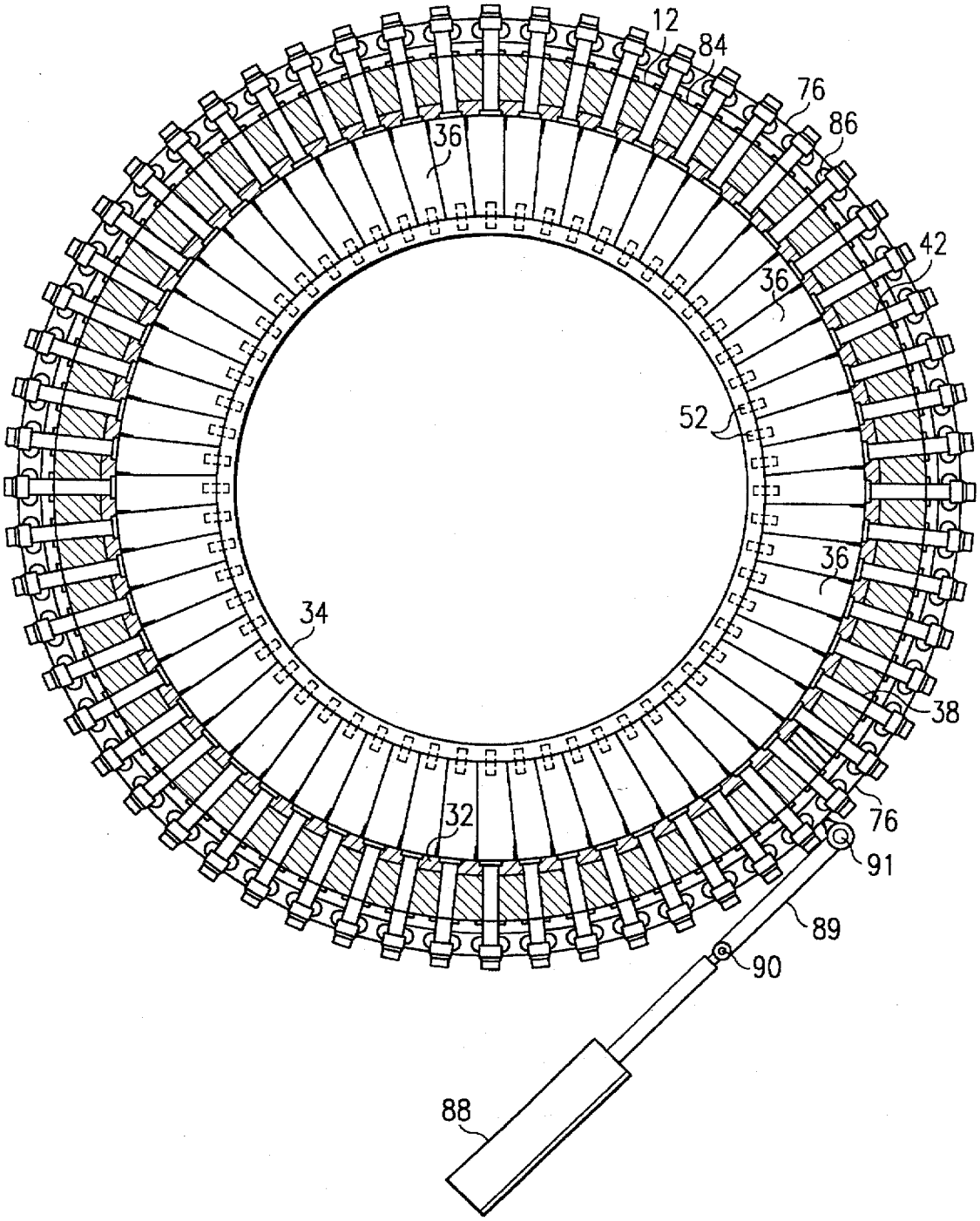
FIG. 3 is a view of the stator vane assembly of FIG. 1, partly in cross-section, taken in a plane perpendicular to the longitudinal axis of the rotor shaft.

As shown in FIG. 3, the synchronizing ring 76 in the first embodiment is positioned radially outwardly from and concentric to outer shroud 32 and inner shroud 34. The distal end of a piston rod of a hydraulic actuator 88 is pivotally attached to one end of a link 89 by a pivot pin 90, while the other end of link 89 is pivotally attached to the synchronizing ring 76 by a fastener 91. The cylinder of actuator 88 can be supported by housing 12. Thus, one direction of movement of the piston of the actuating means 88 rotates the synchronizing ring 76 in a first direction, while the other direction of movement of the piston of the actuating means 88 rotates the synchronizing ring 76 in the opposite direction. The rotary movement of the rotatable stator vanes can increase the space between the laterally adjacent edges of each adjacent pair of rotatable stator vanes 36 or decrease the space between the laterally adjacent edges of each adjacent pair of rotatable stator vanes 36, thereby permitting a control of the pressure level of the exhaust gas 28 at the inlet of the turbine blades 18. A signal for controlling the actuator means 88 can be transmitted from the FCCU. Instead of a hydraulic actuator, the actuator means 88 can be a screw actuator or any other suitable mechanism.

As illustrated in FIG. 2, a circular sealing bellows 78 prevents the escape of exhaust gas 28 between housing 12 and the upstream end of the outer shroud 32. A flexible seal 82 prevents the escape of exhaust gas 28 between housing 12 and the downstream end of the outer shroud 32. A rotor seal ring 50 is mounted on the downstream structure of the heat shield 25 and is provided with an annular knife edge 83 which extends radially inwardly toward an annular shoulder 84 on rotor 14 to provide a seal of the gap between the heat shield 25 and the rotor 14.

Figure 4:
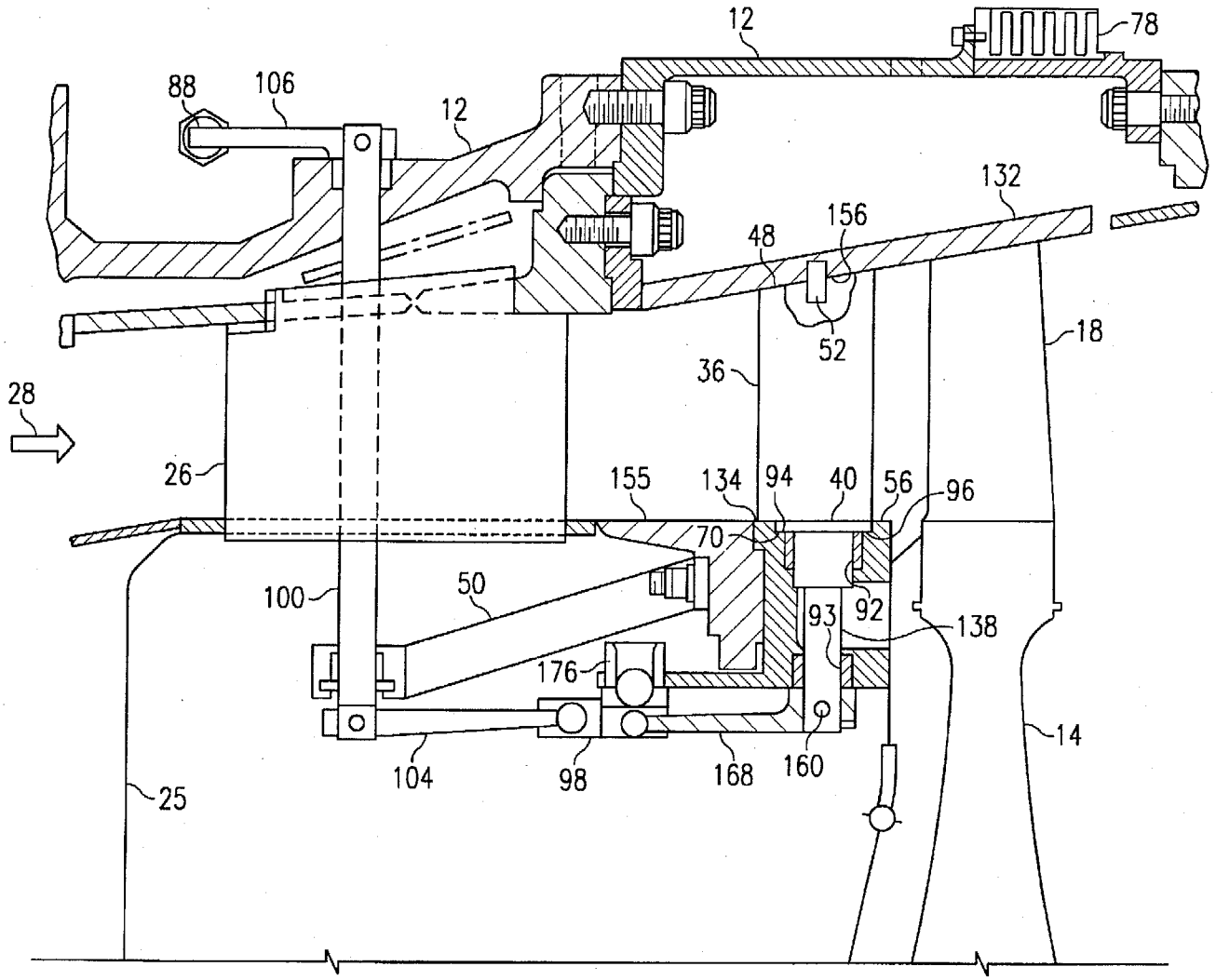
FIG. 4 is a partial, cross-sectional view of a second embodiment of a stator vane assembly constructed in accordance with the present invention.

FIG. 4 illustrates the structural details of a second embodiment of an adjustable stator vane assembly constructed in accordance with the present invention. Elements which are the same as in the first embodiment have been identified with the same reference characters, and a detailed description thereof is not repeated. In this second embodiment, the radial orientation of adjustable stator vanes 36 is one hundred eighty degrees from the orientation of the rotatable stator vanes 36 in the embodiment of FIG. 1. Thus, the shaft 138 of each rotatable stator vane 36 passes through vane shaft bushings 92 and 93 which are positioned in coaxial apertures in inner shroud 134, while the pivot pin 52 is mounted in one of the vane tip end 48 and the outer shroud 132 and extends into the other one so that the rotatable stator vanes 36 can be rotated about the longitudinal axis of the vane shaft 138. The first end of actuation arm 168 is attached to the distal end of the stator vane shaft 138 by fastener 160 to hold the annular shoulder 70 of the rotatable Stator vane 36 against the annular shoulder 94 surrounding an aperture in the inner shroud 134. The surface 156 of the outer shroud 132 adjacent to the tip end 48 of each rotatable stator vane 36 has a convex spherical contour and the surface of the tip end 48 of the rotatable stator vane 36 has a mating concave spherical contour so that the clearance between the surface 156 and the tip end 48 does not change when the rotatable stator vanes 36 are rotated about their longitudinal axes. This enables the clearance between the tip end 48 and the outer shroud 132 to be maintained at a minimum. The distal end of each actuation arm 168 is pivotally connected to the synchronizing ring 176, while a coupling means 98 pivotally connects one end of an arm 104 to the ring 176. The other end of arm 104 is connected to the inner end of shaft 100, while the outer end of shaft 100, which passes through a hollow strut 26, is connected through an arm 106 to actuator 88. Actuator 88 controls the synchronized rotational movement of rotatable stator vanes 36. In this embodiment, the synchronizing ring 176, the actuation arm 168, coupling means 98, arm 104, and the inner end of shaft 100 are located inwardly of the inner shroud 134 and between the heat shield 25 and the rotor 14,1while the actuator 88, the arm 106, and the outer end of shaft 100 are located externally of the housing 12.

Figure 5:
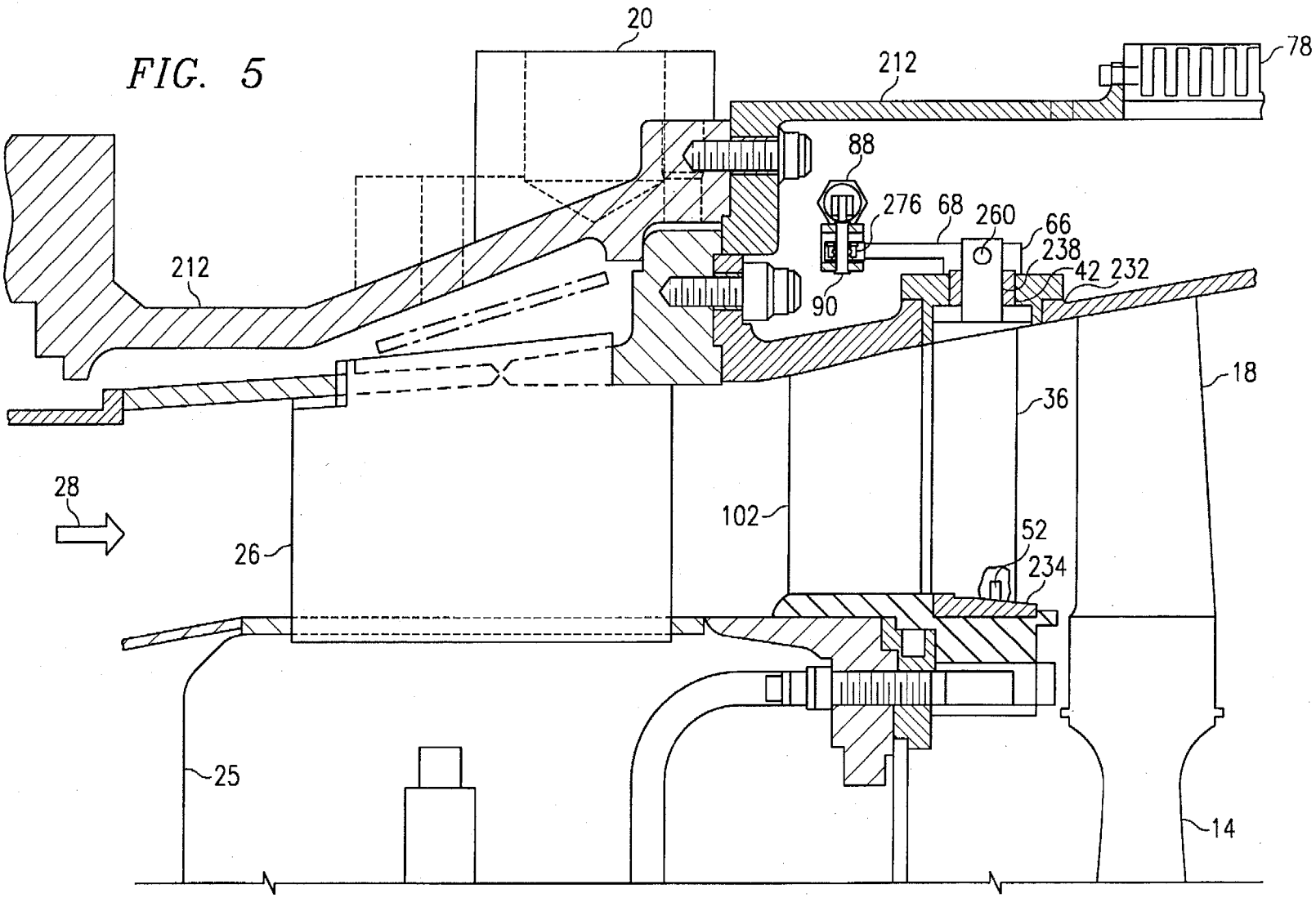
FIG. 5 is a partial, cross-sectional view of a third embodiment of a stator vane assembly constructed in accordance with the present invention.

FIG. 5 illustrates the structural details of another embodiment of an adjustable stator vane assembly constructed in accordance with the present invention. This embodiment represents a modification of the embodiment of FIG. 1, wherein a plurality of non-movable or stationary stator vanes 102 is positioned upstream from the movable stator vanes 36, and wherein the synchronizing ring 276 and the actuator 88 are positioned exteriorly of the outer shroud 232 and internally of the housing 212. The fixed stator vanes 102 are spaced apart at equal intervals about the circumference of the inner shroud 234 and extend at least generally radially outwardly from the inner shroud 234 to the outer shroud 232. The addition of the non-movable or stationary stator vanes 102 allows the movable stator vanes 36 to be smaller in physical size than the movable stator vanes 36 disclosed in FIG. 1. While the number of stationary stator vanes 102 can differ from the number of movable stator vanes 36, it is presently preferred for the number of stationary stator vanes 102 to be equal to the number of movable stator vanes 36, with each movable vane 36 being positioned between an adjacent pair of stationary stator vanes 102 and slightly downstream of the stationary stator vanes 102.

Although the present invention has been described with reference to a presently preferred embodiment, it will be appreciated by those skilled in the art that various modifications, alternatives, variations, etc., may be made without departing from the spirit and scope of the invention as defined in the appended claims.

I claim:

1. An adjustable stator vane assembly comprising:

an annular outer shroud;

an annular inner shroud positioned within and concentric to said annular outer shroud so as to form an annular flow path therebetween;

a plurality of vane shaft bushings;

a plurality of rotatable stator vanes, each of said rotatable stator vanes being positioned between said inner shroud and said outer shroud and spaced apart from each other about the circumference of said inner shroud, each of said rotatable stator vanes having a first end and a second end, each of said rotatable stator vanes having a vane shaft attached to the first end of the respective rotatable stator vane, each vane shaft being mounted in a respective one of said vane shaft bushings for rotational movement of the associated rotatable stator vane about a longitudinal axis of the respective rotatable stator vane;

a synchronizing ring;

an actuator for providing arcuate motion of said synchronizing ring;

a plurality of actuation linkages, one end of each actuation linkage being attached to a respective one of said vane shafts and the other end of each actuation linkage being attached to said synchronizing ring;

whereby each of said plurality of rotatable stator vanes can be simultaneously rotated about its longitudinal axis by said actuator providing arcuate motion of said synchronizing ring;

a clearance being established between the second end of the rotatable stator vanes and one of said shrouds, the clearance being maintained at approximately 0.01 inch wherein the second end of each of said rotatable stator vanes has a spherical tip surface and the shroud which is juxtaposed to said second end of each of said rotatable stator vanes has a mating spherical surface so that a clearance between said second end and said mating spherical surface does not change appreciably when the rotatable stator vanes are rotated.

2. An adjustable stator vane assembly comprising:

an annular outer shroud;

an annular inner shroud positioned within and concentric to said annular outer shroud so as to form an annular flow path therebetween;

a plurality of vane shaft bushings;

a plurality of rotatable stator vanes, each of said rotatable stator vanes being positioned between said inner shroud and said outer shroud and spaced apart from each other about the circumference of said inner shroud, each of said rotatable stator vanes having a first end and a second end, each of said rotatable stator vanes having a vane shaft attached to the first end of the respective rotatable stator vane, each vane shaft being mounted in a respective one of said vane shaft bushings for rotational movement of the associated rotatable stator vane about a longitudinal axis of the respective rotatable stator vane;

a synchronizing ring;

an actuator for providing arcuate motion of said synchronizing ring;

a plurality of actuation linkages, one end of each actuation linkage being attached to a respective one of said vane shafts and the other end of each actuation linkage being attached to said synchronizing ring;

whereby each of said plurality of rotatable stator vanes can be simultaneously rotated about its longitudinal axis by said actuator providing arcuate motion of said synchronizing ring;

each of said vane shaft bushings being mounted in a first one of said inner shroud and said outer shroud;

each second end of a rotatable stator vane having a pivot pin extending therefrom into a second one of said inner shroud and said outer shroud;

the second end of each of said rotatable stator vanes having a spherical tip surface centered on the longitudinal axis of said rotatable stator vane and the shroud which is juxtaposed to said second end of each of said rotatable stator vanes having a mating spherical surface so that a clearance between said second end and said mating spherical surface does not change appreciably when the rotatable stator vanes are rotated.

3. An adjustable stator vane assembly comprising:

an annular outer shroud;

an annular inner shroud positioned within and concentric to said annular outer shroud so as to form an annular flow path therebetween;

a plurality of vane shaft bushings;

a plurality of rotatable stator vanes, each of said rotatable stator vanes being positioned between said inner shroud and said outer shroud and spaced apart from each other about the circumference of said inner shroud, each of said rotatable stator vanes having a first end and a second end, each of said rotatable stator vanes having a vane shaft attached to the first end of the respective rotatable stator vane, each vane shaft being mounted in a respective one of said vane shaft bushings for rotational movement of the associated rotatable stator vane about a longitudinal axis of the respective rotatable stator vane;

a synchronizing ring;

an actuator for providing arcuate motion of said synchronizing ring:

a plurality of actuation linkages, one end of each actuation linkage being attached to a respective one of said vane shafts and the other end of each actuation linkage being attached to said synchronizing ring;

whereby each of said plurality of rotatable stator vanes can be simultaneously rotated about its longitudinal axis by said actuator providing arcuate motion of said synchronizing ring;

each of said vane shaft bushings being mounted in a first one of said inner shroud and said outer shroud;

each second end of a rotatable stator vane having a pivot pin extending therefrom into a second one of said inner shroud and said outer shroud;

said outer shroud being a single annular piece which is continuous about its circumferential periphery;

said inner shroud being a single annular piece which is continuous about its circumferential periphery;

said inner shroud being formed of a material having a coefficient of thermal expansion which is larger than that of the material of the outer shroud so that, upon heating by exposure to hot fluid passing through said annular flow path, a clearance between the second end of each rotatable stator vane and the inner shroud does not appreciably change from a temperature of approximately 70° F. to a temperature of approximately 1300° F.

4. An adjustable stator vane assembly comprising:

an annular outer shroud;

an annular inner shroud positioned within and concentric to said annular outer shroud so as to form an annular flow path therebetween;

a plurality of vane shaft bushings;

a plurality of rotatable stator vanes, each of said rotatable stator vanes being positioned between said inner shroud and said outer shroud and spaced apart from each other about the circumference of said inner shroud, each of said rotatable stator vanes having a first end and a second end, each of said rotatable stator vanes having a vane shaft attached to the first end of the respective rotatable stator vane, each vane shaft being mounted in a respective one of said vane shaft bushings for rotational movement of the associated rotatable stator vane about a longitudinal axis of the respective rotatable stator vane;

a synchronizing ring;

an actuator for providing arcuate motion of said synchronizing ring;

a plurality of actuation linkages, one end of each actuation linkage being attached to a respective one of said vane shafts and the other end of each actuation linkage being attached to said synchronizing ring;

whereby each of said plurality of rotatable stator vanes can be simultaneously rotated about its longitudinal axis by said actuator providing arcuate motion of said synchronizing ring;

said inner shroud being a single annular piece which is continuous about its circumferential periphery, and wherein said inner shroud is formed of a material having a coefficient of thermal expansion which is larger than that of the material of the outer shroud so that, upon heating by exposure to hot fluid passing through said annular flow path, a clearance between the second end of each rotatable stator vane and the inner shroud does not appreciably change from a temperature of approximately 70° F. to a temperature of approximately 1300° F.

5. A turbomachine comprising:

a rotor shaft;

a rotor mounted on said rotor shaft;

a plurality of rotor blades mounted on said rotor;

an annular outer shroud;

an annular inner shroud positioned within and concentric to said annular outer shroud so as to form an annular flow path therebetween for fluid passing toward said rotor blades;

a plurality of vane shaft bushings;

a plurality of rotatable stator vanes, each of said rotatable stator vanes being positioned between said inner shroud and said outer shroud and spaced apart from each other about the circumference of said inner shroud, each of said rotatable stator vanes having a first end and a second end, each of said rotatable stator vanes having a vane shaft attached to the first end of the respective rotatable stator vane, each vane shaft being mounted in a respective one of said vane shaft bushings for rotational movement of the associated rotatable stator vane about a longitudinal axis of the respective rotatable stator vane;

a synchronizing ring;

an actuator for providing arcuate motion of said synchronizing ring;

a plurality of actuation linkages, one end of each actuation linkage being attached to a respective one of said vane shafts and the other end of each actuation linkage being attached to said synchronizing ring;

whereby each of said plurality of rotatable stator vanes can be simultaneously rotated about its longitudinal axis by said actuator providing arcuate motion of said synchronizing ring;

each of said vane shaft bushings being mounted in a first one of said inner shroud and said outer shroud, and each second end of a rotatable stator vane having a pivot pin extending therefrom into a second one of said inner shroud and said outer shroud;

the second end of each of said rotatable stator vanes having a spherical tip surface centered on the longitudinal axis of said rotatable stator vane and the shroud which is juxtaposed to said second end of each of said rotatable stator vanes having a mating spherical surface so that a clearance between said second end and said mating spherical surface does not change appreciably when the rotatable stator vanes are rotated.

6. A turbomachine comprising:

a rotor shaft;

a rotor mounted on said rotor shaft;

plurality of rotor blades mounted on said rotor;

an annular outer shroud;

an annular inner shroud positioned within and concentric to said annular outer shroud so as to form an annular flow path therebetween for fluid passing toward said rotor blades;

a plurality of vane shaft bushings;

a plurality of rotatable stator vanes, each of said rotatable stator vanes being positioned between said inner shroud and said outer shroud and spaced apart from each other about the circumference of said inner shroud, each of said rotatable stator vanes having a first end and a second end, each of said rotatable stator vanes having a vane shaft attached to the first end of the respective rotatable stator vane, each vane shaft being mounted in a respective one of said vane shaft bushings for rotational movement of the associated rotatable stator vane about a longitudinal axis of the respective rotatable stator vane;

a synchronizing ring;

an actuator for providing arcuate motion of said synchronizing ring;

a plurality of actuation linkages, one end of each actuation linkage being attached to a respective one of said vane shafts and the other end of each actuation linkage being attached to said synchronizing ring;

whereby each of said plurality of rotatable stator vanes can be simultaneously rotated about its longitudinal axis by said actuator providing arcuate motion of said synchronizing ring;

the outer shroud being a single annular piece which is continuous about its circumferential periphery, said outer shroud being formed of a material having a coefficient of thermal expansion which is smaller than that of the material of the inner shroud so that, upon heating by exposure to hot fluid passing through said annular flow path, a radial distance between the inner shroud and the outer shroud increases at substantially the same rate as the length of the rotatable stator vane increases;

said inner shroud being a single annular piece which is continuous about its circumferential periphery, and wherein said inner shroud is formed of a material having a coefficient of thermal expansion which is larger than that of the material of the outer shroud so that, upon heating by exposure to hot fluid passing through said annular flow path, a clearance between the second end of each rotatable stator vane and the inner shroud does not appreciably change from a temperature of approximately 70° F. to a temperature of approximately 1300° F.

7. An adjustable stator vane assembly comprising:

an annular outer shroud;

an annular inner shroud positioned within and concentric to said annular outer shroud so as to form an annular flow path therebetween;

a plurality of vane shaft bushings;

a plurality of rotatable stator vanes, each of said rotatable stator vanes being positioned between said inner shroud and said outer shroud and spaced apart from each other about the circumference of said inner shroud, each of said rotatable stator vanes having a first end and a second end, each of said rotatable stator vanes having a vane shaft attached to the first end of the respective rotatable stator vane, each vane shaft being mounted in a respective one of said vane shaft bushings for rotational movement of the associated rotatable stator vane about a longitudinal axis of the respective rotatable stator vane;

the vane shaft bushings being mounted in the annular inner shroud, the vane shaft passing through the annular inner shroud;

a synchronizing ring;

an actuator for providing arcuate motion of said synchronizing ring;

a plurality of actuation linkages, one end of each actuation linkage being attached to a respective one of said vane shafts and the other end of each actuation linkage being attached to said synchronizing ring;

whereby each of said plurality of rotatable stator vanes can be simultaneously rotated about its longitudinal axis by said actuator providing arcuate motion of said synchronizing ring wherein at least a portion of the actuator lies radially exterior the annular outer shroud.

8. An adjustable stator vane assembly in accordance with claim 1, wherein each of said vane shaft bushings is mounted in a first one of said inner shroud and said outer shroud.

9. An adjustable stator vane assembly in accordance with claim 8, wherein each second end of a rotatable stator vane has a pivot pin extending therefrom into a second one of said inner shroud and said outer shroud.

10. An adjustable stator vane assembly in accordance with claim 2, wherein said clearance is approximately 0.01 inch.

11. An adjustable stator vane assembly in accordance with claim 9, wherein said outer shroud is a single annular piece which is continuous about its circumferential periphery.

12. An adjustable stator vane assembly in accordance with claim 11, wherein said outer shroud is formed of a material having a coefficient of thermal expansion which is smaller than that of the material of the inner shroud so that, upon heating by exposure to hot fluid passing through said annular flow path, a radial distance between the inner shroud and the outer shroud increases at substantially the same rate as the length of a rotatable stator vane increases.

13. An adjustable stator vane assembly in accordance with claim 11, wherein said inner shroud is a single annular piece which is continuous about its circumferential periphery.

14. An adjustable stator vane assembly in accordance with claim 1, further including a plurality of fixed stator vanes positioned upstream of said plurality of rotatable stator vanes.

15. An adjustable stator vane assembly in accordance with claim 1, wherein said outer shroud is a single annular piece which is continuous about its circumferential periphery, and wherein said outer shroud is formed of a material having a coefficient of thermal expansion which is smaller than that of the material of the inner shroud so that, upon heating by exposure to hot fluid passing through said annular flow path, a radial distance between the inner shroud and the outer shroud increases at substantially the same rate as the length of a rotatable stator vane increases.

16. A turbomachine in accordance with claim 5, further including a plurality of fixed stator vanes positioned upstream of said plurality of rotatable stator vanes.

17. A turbomachine in accordance with claim 5, wherein said outer shroud is a single annular piece which is continuous about its circumferential periphery, and wherein said outer shroud is formed of a material having a coefficient of thermal expansion which is smaller than that of the material of the inner shroud so that, upon heating by exposure to hot fluid passing through said annular flow path, a radial distance between the inner shroud and the outer shroud increases at substantially the same rate as the length of a rotatable stator vane increases.

18. A turbomachine in accordance with claim 6, wherein said clearance is approximately 0.01 inch.

19. The adjustable stator vane assembly of claim 7, wherein the synchronizing ring is concentric to and lies radially inward of the annular inner shroud.

* * * * *